United States Patent [19]

Sato

[11] Patent Number: 4,966,635

[45] Date of Patent: Oct. 30, 1990

[54] METHOD OF MAKING A COMPOUND CABLE

[75] Inventor: Kenichi Sato, Osaka, Japan

[73] Assignee: Sumitomo Electric Industries, Ltd., Osaka, Japan

[21] Appl. No.: 225,661

[22] Filed: Jul. 27, 1988

Related U.S. Application Data

[60] Continuation of Ser. No. 559,682, Dec. 9, 1983, abandoned, which is a division of Ser. No. 263,919, May 15, 1981, Pat. No. 4,463,219.

[30] Foreign Application Priority Data

May 16, 1980 [JP] Japan ..... 55-65615
Jun. 11, 1980 [JP] Japan ..... 55-79416

[51] Int. Cl.[5] ..... H01B 5/08

[52] U.S. Cl. ..... 148/275; 57/200; 148/285; 174/23 R; 174/127; 174/128.1; 174/130; 204/40; 427/2; 585/15

[58] Field of Search ..... 174/23 C, 23 R, 73, 174/127, 128 R, 128 BL, 130, 140 RC, 140 CR, 140 S, 140 H, 144; 57/200; 204/40; 427/2; 428/457; 585/15; 29/825, 885

[56] References Cited

U.S. PATENT DOCUMENTS

| | | | |
|---|---|---|---|
| 3,039,898 | 6/1962 | Keller | 148/6.14 R |
| 3,247,026 | 4/1966 | Switzer | 148/6.3 |
| 3,676,578 | 7/1972 | Cahill | 174/128 R |
| 3,734,782 | 5/1973 | LaRoche | 148/6.3 |
| 3,806,626 | 4/1974 | Liao | 174/40 R |
| 3,813,481 | 5/1974 | Adams | 174/130 |
| 3,930,113 | 12/1975 | Johansen et al. | 174/40 R |
| 4,292,095 | 9/1981 | Schlinsog | 148/6.14 R |
| 4,463,219 | 7/1984 | Sato | 174/127 |
| 4,759,805 | 7/1988 | Saruwatari et al. | 174/127 X |

FOREIGN PATENT DOCUMENTS

| | | | |
|---|---|---|---|
| 549885 | 12/1957 | Canada | 174/127 |
| 1128494 | 4/1962 | Fed. Rep. of Germany | 174/127 |

OTHER PUBLICATIONS

Comber, M. G. et al., "Audible-Noise Reduction by Bundle Geometry Optimization"; IEEE Power Engineering Society; IEEE PES Winter Meeting, New York, N.Y., Jan.-Feb. 1973; Nov. 1972; pp. 1782-1789.

*Primary Examiner*—Morris H. Nimmo
*Attorney, Agent, or Firm*—Wenderoth, Lind & Ponack

[57] ABSTRACT

The invention relates to a compound cable, such as an aluminum cable, an aluminum alloy cable, aluminum cable steel reinforced or an aluminum alloy cable steel reinforced with reduced audible noise for use in a high voltage transmission line.

The surface of each of the aluminum wires to constitute the outermost layer of the cable is treated in water or aqueous vapor of more than 90° C. so as to form a hydrophilic hydrated film on said surface, or more than 3 grooves are provided on the outer periphery of each of the aluminum wires in excess of 30% of such wires to constitute the outermost layer of the cable, a hydrated film being caused to form on the surface including the grooves thereof, so that the raindrops adhering to the surface may readily disappear due to the improved hydrophilic property and draining property of the surface of the cable thereby preventing the development of the corona discharge.

8 Claims, 2 Drawing Sheets

METHOD OF MAKING A COMPOUND CABLE

This application is a continuation, of now abandoned application Ser. No. 06/559,682, filed Dec. 9, 1983, which is a divisional of application Ser. No. 263,919, filed May 15, 1981, now U.S. Pat. No. 4,463,219.

The invention relates to a compound cable comprising an aluminum cable, an aluminum alloy cable, an aluminum cable steel reinforced or aluminum alloy cable steel reinforced with reduced audible noise for use in a high voltage transmission line.

The aluminum cable, aluminum alloy cable, aluminum cable steel reinforced or aluminum alloy cable steel reinforced (hereinafter referred to as a compound cable) conventionally used in the overhead transmission line has played an important role in power transmission. In recent years the transmission voltage has come to be elevated due to the necessity of large capacity transmission. However, when the voltage is as high as, for example, 1000 KV, the corona discharge, particularly the audible noise directly after rainfall, poses a problem.

The audible noise directly after rainfall is caused by the corona discharge produced by the elevated surface potential gradient around the raindrop projecting beyond the surface of the compound cable. The invention has succeeded in preventing the generation of the corona discharge by increasing the wetness (hydrophilic property) as well as the draining property of the surface of the compound cable thereby causing the raindrops to disappear quickly from said surface.

The hydrophilic property can be imparted to the aluminum surface by various methods. However, the anodic oxidization treatment has a disadvantage in that it is necessary to remove a rigid insulating film formed on the surface.

The invention has been made as a result of a series of tests for the elimination of the said disadvantage. The invention is firstly characterized in that it can provide a compound cable with reduced audible noise by forming a specific surface treatment film on the surface of the aluminum wires or aluminum alloy wires (hereinafter referred to as aluminum wires) to constitute the outermost layer of the cable thereby improving the hydrophilic property of the surface of said cable.

The invention is secondly characterized in that (1) more than 30% of the aluminum element wires to constitute at least the outermost layer of the cable are provided on the outer peripheries thereof with more than 3 grooves formed continuously and longitudinally of said wires respectively, that (2) a specific surface treatment film is provided on the surface including the grooves of each of the element wires, and that (3) said specific surface treatment film is provided after subjecting the surface of the element wire to rough surface treatment; thereby proving a compound cable with reduced audible noise.

In detail, the invention is characterized in that the surface of a compound cable comprising aluminum wires stranded around the outer periphery of a steel core is subjected to a treatment in water or aqueous vapor at a temperature of 90° C. or greater or in aqueous vapor having a temperature above 120° C. and a pressure above 2 kg/cm$^2$ so as to produce a hydrated film thereon thereby enabling the surface of the cable to have a hydrophilic property.

The invention is further characterized in that more than 3 grooves are formed on the outer peripheries of more than 30% of the aluminum wires to constitute at least the outermost layer of the cable continuously and longitudinally of said aluminum wires, respectively.

The outline of the accompanying drawings in the present invention is as follows.

FIG. 4(A) to (D) show cross-sectional views illustrating further embodiments of the grooves formed on the aluminum wires in different numbers and configurations, respectively.

Figure 1A:
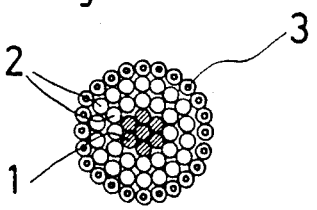
FIGS. 1A and 2A are cross-sectional views showing embodiments of the compound cable according to the invention in which aluminum wires having hydrated films on the surfaces thereof respectively are used in the outermost layer of said cable.
Figure 1B:
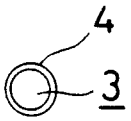
FIGS. 1B and 2B are exploded views of treated wires of the invention.
Figure 2A:
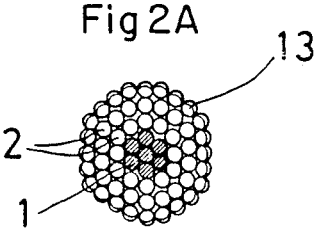
Figure 2B:
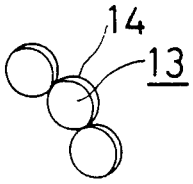

A compound cable of the present invention will be described based on an aluminum cable steel reinforced (ACSR) as one of the most typical compound cables as follows:

In FIG. 1A, around a steel reinforcement there are stranded an inner layer comprising aluminum wires 2 and then an outermost layer comprising aluminum wires 3 with surface treatment films formed on the surfaces thereof. In FIG. 2A, aluminum wires 2 and 13 are stranded around a steel reinforcement 1, surface treatment films 14 being formed on the outermost surfaces of the aluminum wires 13 constituting the outermost layer.

According to the invention, the surface treatment film is formed on the surface of each of the aluminum wires to constitute the outermost surface of the cable either by treating the surface of the compound cable or by treating the surfaces in the state of element wires prior to stranding of said element wires into a compound cable. In both cases, it is essential that the wire drawing lubricant is completely removed by an organic solvent before the film is formed on the surface.

In order to obtain a greater effect, it is preferable that the surface of the aluminum wire is subjected to a rough surface treatment, such as blasting, liquid honing, etc., after the oil removing process by means of the organic solvent. According to the invention, the blast treatment comprises the ordinary sand blasting and shot blasting. The roughness of the surface treated by blasting or liquid honing is preferably about 10–50$\mu$ since it has an advantage in that not only the hydrophilic property is satisfactory after the formation of the hydrated film but also mass production is feasible from the industrial viewpoint.

When the surface of the ACSR is simply subjected to the blast treatment or liquid honing treatment, the beads of raindrops adhering to the surface have the same effect as the aforesaid projections thereof. It is impossible, therefore, to reduce the audible noise. When hydrated film is formed on the surface in the water or aqueous vapor of 90° C. and upward after it has been subjected to blast treatment or liquid honing treatment, the surface has an improved hydrophilic property. Thus the raindrops are uniformly dispersed over the surface without forming beads thereby greatly reducing the corona discharge and accordingly the audible noise. Generally, when a body is brought into contact with water, the relation between the contact angle $\theta$ in case of a plane-faced body and the contact angle $\theta'$ in case of a rough-faced body is as follows.

$$\frac{\cos\theta'}{\cos\theta} = \frac{\text{true surface area}}{\text{apparent surface area}} = r$$

In case of a rough face, the true surface area is larger than the apparent surface area. Since $r \geqq 1$, in case of $0° < \theta > 90°$, $\theta \leqq \theta$. Thus the apparent contact angle becomes smaller, whereby the hydrophilic property of the rough face is improved.

However, a simple treatment of blasting or liquid honing is not sufficient to prevent the raindrops from forming projections on the surface. Since the corona discharge is substantially the same as in the case of the ordinary ACSR, there is no improvement in the reduction of the audible noise. Thus it has been found that the hydrophilic property is never improved by simply roughening the surface. When the hydrated film is caused to form in water or aqueous vapor of 90° C. or greater after the surface has been sujected to blast treatment or liquid honing treatment, the film is produced in greater amounts under the same conditions since the surface area has been increased due to the roughening process compared with that of the ordinary ACSR. In addition, the surface roughness of about 10–50 $\mu$ after the blast treatment or liquid honing treatment is substantially doubled to about 20–100$\mu$. Thus it has been found that the hydrophilic property of the surface of the cable is remarkably increased by the multiplied effect of the improved hydrophilic property due to the hydrated film combined with the further roughening of the surface.

According to the invention, the hydrated film is caused to form in water or aqueous vapor of 90° C. or greater so that the surface may have higher hydrophilic property and the surface roughness may substantially be twice as large as that after the blast or liquid honing treatment thereby drastically improving the hydrophilic property of the surface of the cable. When treated in aqueous vapor, the hydrophilic property is further increased compared with the case of the water treatment in the same period of time.

If the temperature of the water or aqueous vapor is lower than 90° C., the hydrophilic property of the surface is not improved satisfactorily. In case of the aqueous vapor, if the surface is treated in aqueous vapor of a high temperature above 120° C. having a pressure of 2 kg/cm$^2$ and upward, the hydrated film can be formed in a shorter period of time compared with the case of the ordinary atmospheric pressure. The film has higher crystallizing property and stability compared with the film produced at a low temperature. A surface treatment film of higher hydrophilic property is obtainable in the same period of time of treatment. To be more precise, the invention has an industrial advantage in that a predetermined hydrophilic property is obtainable in a shorter period of processing time.

When the aqueous vapor has a pressure less than 2 kg/cm$^2$ and a temperature below 120° C., it is impossible to obtain a surface treatment film of high hydrophilic property and stability. In practice, however, either the pressure or the temperature can be conformed to the said conditions, since there is a correlation between the pressure and the temperature of the aqueous vapor. The surface treatment film under the said conditions has a thickness below 10% of that of the anodized film. Thus the film according to the invention is readily broken when the wires are connected by means of a compression type sleeve thereby enabling an electric contact to be formed between the ACSR and the sleeve. The invention, therefore, has an advantage in that there is no necessity for removing the film.

The invention will now be described in detail in relation to the second characteristic thereof in which more than 3 grooves are formed on the outer periphery of each of the aluminum wires of the outermost layer continuously and longitudinally thereof.

When more than 3 grooves are formed on the outer periphery of an aluminum element wire continuously and longitudinally of said wire, the number, size and configuration of the grooves have a great influence not only on the formation of waterdrops but also on the tensile strength and vibration fatigue resistance of the element wire and accordingly the ACSR.

According to the invention, on the outer periphery of each of the aluminum element wires to constitute at least the outermost layer of the ACSR, there are formed more than 3 grooves continuously and longitudinally of said element wire for the following reasons. In order to reduce the audible noise, it is necessary that the hemispherical waterdrops formed on the outer surface of the ACSR are caused to disappear. If more than 3 grooves are formed on the surface of each of the element wires to constitute the outermost layer of the ACSR for the said object, at least one groove appears on the surface of each of the element wires constituting the outermost layer of the ACSR exposed to the atmosphere, raindrops being entrapped into the grooves due to the geometric configuration thereof. Thus the hemispherical raindrops on the surface are reduced in number, while water flows along the grooves, thereby greatly increasing the draining property of the surface of the cable.

The grooves are provided on at least more than 30% of the element wires constituting the outermost layer of the cable inasmuch as, if less than that, no satisfactory effect can be expected.

The opening of the groove should have a width of 0.1–2 mm, since if wider than 2 mm, the draining property is impaired and accordingly the effect of reducing the audible noise is reduced, the same being applicable to the case of less than 0.1 mm. The depth of the groove should be 2–25% of the thickness of the element wire since if below 2%, the groove is imperfect in its configuration, while if deeper than 25%, the vibration fatigue resistance is reduced thereby posing a problem in respect of practical use. FIGS. 3 and 4 4A to 4D show element wires S having grooves of U-shaped profiles and arcuate profiles, respectively. Though the groove may have a V-shaped profile, a U-shaped profile is preferable because of its smaller stress concentration.

A hydrated film is formed on the outer surface of the aluminum wire including the grooves formed thereon in aqueous vapor having a temperature of 120° C. or greater, and preferably in water or aqueous vapor above 90° C. after the outer surface has been subjected to rough surface treatment.

The aqueous vapor treatment should be effected at a temperature above 120° C. inasmuch as the film can be formed in a shorter period of time. Moreover, the film thus obtained has higher crystallizing property and stability compared with the film obtained at a lower temperature, thereby improving the hydrophilic property and draining property and accordingly reducing the audible noise.

The hydrated film is provided on the surface including the grooves of each of the element wires to constitute the outermost layer of the cable. Alternatively, said film may be provided on the outer surfaces of the grooved element wires constituting the outermost layer of the cable after it has been stranded. The effect is identical in both cases.

According to the invention, more than 3 grooves are formed on the periphery of each of the element wires corresponding to 30% or greater of the element wires constituting the outermost layer of the cable thereby reducing the audible noise in conformity with the object of the invention. It is also within the scope of the invention to provide more than 3 grooves not only on the element wires of the outermost layer but also on all the aluminum wires with exception of the core wires thereby reducing the weight of the compound cable, for example, ACSR.

According to the invention, the reinforcement in the center of the cable comprises all kinds of steel wires, aluminum wires and the like used singly or in plurality.

A compound cable the outermost surface of which is composed of a surface treatment film as described hereinbefore, or a compound cable in which more than 3 grooves are formed on each outer periphery of more than 30% of the element wires to constitute the outermost layer continuously and longitudinally of said wires, or a compound cable on which a hydrated film is formed or a hydrated film is formed after rough surface treatment has an advantage in that not only its hydrophilic property but also its draining property is improved thereby reducing the audible noise in a short period of time directly after rainfall.

Although the aluminum cable steel reinforced as one of the compound cables has been described in detail, it is to be understood that the present invention is not limited to ACSR only, but that a core wire composed of steel wire or aluminum wire and a cable in combination with a steel wire or aluminum wire may be used. In the present invention, it is necessary that at least the outermost layer of the cable is composed of a compound cable consisting of an aluminum wire, aluminum alloy wire, aluminum-clad steel wire or aluminum-alloy-clad steel wire.

The invention will hereinunder be described in detail in reference to the following examples.

EXAMPLE 1

Heat resisting aluminum alloy wires were stranded into ACSR (60 T ACSR) having a sectional area of 810 $mm^2$ and a conductivity of 60%, the surface thereof being subjected to continuous sand blast treatment until the surface roughness of the aluminum alloy wires of the surface of the ACSR was on the order of 15$\mu$.

The cable thus obtained was subjected to oil removing treatment by an organic solvent, hydrated films being caused to form under different conditions as shown in Table 1, to produce ACSR samples according to the invention.

By way of comparison, there were produced an ordinary new 60 T ACSR (No. 13), 60 T ACSR subjected to sand blast treatment only (No. 12), and 60 T ACSR treated under the conditions of No. 14 and No. 15 of Table 1 after sand blast treatment.

An audible noise test was made on said ACSR samples, the results being as shown in Table 1. The audible noise test was made by comparing the audible noises at a maximum surface potential gradient of 15.5 KV/cm after flooding for 1 minute at an intensity of 1.6 mm/hr on the hypothesis of directly after rainfall. The noise levels (dB, A characteristic) in Table 1 show the values of measurement in the lapse of 5 minutes after flooding.

TABLE 1

| | No. | Treatment Temperature (°C.) | | Treatment Time (min) | Noise Level (dB, A characteristic) |
|---|---|---|---|---|---|
| Samples of Invention | 1 | in | 95 | 5 | 49 |
| | 2 | water | 95 | 10 | 47 |
| | 3 | | 95 | 20 | 46 |
| | 4 | | 95 | 30 | 46 |
| | 5 | | 95 | 50 | 46 |
| | 6 | in | 100 | 15 | 47 |
| | 7 | aqueous | 100 | 30 | 46 |
| | 8 | vapor | 120 | 10 | 46 |
| | 9 | | 120 | 20 | 46 |
| | 10 | | 140 | 10 | 43 |
| | 11 | | 140 | 20 | 44 |
| Comparative Sample | 12 | in | — | — | 54 |
| | 13 | water | — | — | 57 |
| | 14 | | 70 | 30 | 53 |
| | 15 | | 70 | 50 | 52 |

As is clear from Table 1, the ACSR samples according to the invention show lower noise levels by as much as 8–14 dB compared with the ordinary ACSR sample (No. 13). With the comparative sample subjected to sand blast treatment only (No. 12) and those treated in the water of a low temperature (No. 14 and No. 15), the reduction of the noise levels is very small.

EXAMPLE 2

An ACSR (60 T ACSR) having a sectional area of 810 $mm^2$ and a conductivity of 60% was produced by use of heat resisting aluminum alloy wires. The ACSR was de-greased by use of an organic solvent, surface treatment film being caused to form by the batch system under different conditions as shown in Table 2, to obtain ACSR samples according to the invention. Since there is a correlation between the pressure and temperature of the aqueous vapor, the conditions hereinafter will be designated by the pressure only. By way of comparison, there were produced a sample of ordinary new 60 T ACSR in the state in which oil had been removed (No. 8) and 60 T ACSR samples with the surfaces thereof being treated under the conditions of No. 9 and No. 10 of Table 2.

The results of an audible noise test made on said ACSR samples were as shown in Table 2.

The audible noise test was made by comparing the audible noises after flooding at an intensity of 1.6 mm/hr for 1 minute and a maximum surface potential gradient of 15.5 KV/cm on the hypothesis of directly after rainfall. The noise levels (dB, A characteristic) in Table 2 shows the values of measurement in the lapse of 5 minutes after the suspension of flooding.

As is apparent from Table 2, all the ACSR samples according to the invention have lower noise levels by as much as 4–9 dB compared with the noise level of the comparative sample No. 8, while the comparative samples, No. 9 and No. 10, show poor results, the noise level being still high even in the case of No. 10 treated for 60 minutes.

TABLE 2

| | No. | Aqueous Vapor Pressure (Kg/cm$^2$) | Treatment Time (min) | Noise Level (dB, A characteristic) |
|---|---|---|---|---|
| Samples of Invention | 1 | 2.5 | 5 | 50 |
| | 2 | 2.5 | 15 | 47 |
| | 3 | 2.5 | 30 | 47 |
| | 4 | 2.5 | 50 | 46 |
| | 5 | 3.0 | 10 | 46 |
| | 6 | 3.0 | 30 | 46 |
| | 7 | 3.0 | 50 | 45 |
| Comparative Sample | 8 | — | — | 54 |
| | 9 | 1.0 | 30 | 52 |
| | 10 | 1.0 | 60 | 51 |

EXAMPLE 3

Hard-drawn aluminum wires of 4.8 mmϕ were subjected to continuous oil removing treatment and then to aqueous vapor treatment under different conditions as shown in Table 3.

The wires thus treated were stranded as element wires to constitute the outermost layer of ACSR having a sectional area of 810 mm$^2$. Since the wires had no oil on their surfaces, a lubricant was applied thereto prior to stranding so as to prevent the parts brought into contact with guide rolls and the like from receiving damage, said lubricant being removed after stranding.

The samples thus obtained were subjected to the same audible noise test as in Example 1. The results were as shown in Table 3.

TABLE 3

| No. | Aqueous Vapor Pressure (Kg/cm$^2$) | Treatment Time (min) | Noise Level (dB, A Characteristic) |
|---|---|---|---|
| 1 | 3.5 | 5 | 47 |
| 2 | 3.5 | 15 | 46 |
| 3 | 3.5 | 30 | 46 |
| 4 | 4.0 | 1 | 47 |
| 5 | 4.0 | 5 | 46 |
| 6 | 4.0 | 10 | 45 |
| 7 | 4.5 | 0.5 | 47 |
| 8 | 4.5 | 3 | 46 |
| 9 | 4.5 | 5 | 45 |

As is apparent from Table 3, all the ACSR samples according to the invention show highly satisfactory results, the noise levels being reduced by as much as 7–9 dB compared with the case of the comparative sample No. 8 of Table 2.

EXAMPLE 4

Figure 3:
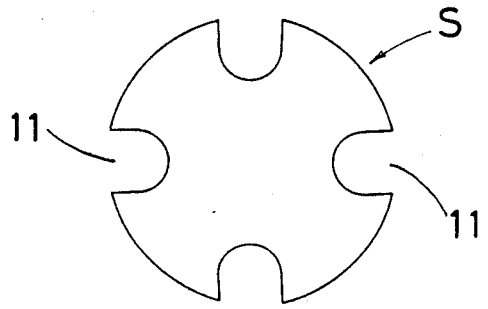
FIG. 3 is a cross-sectional view of an aluminum wire formed with grooves longitudinally thereof according to the invention.
Figure 4A:
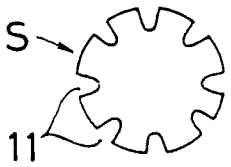
Figure 4B:
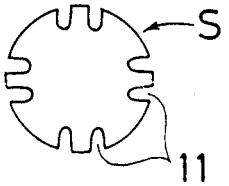
Figure 4C:
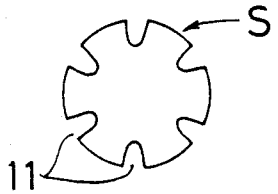
Figure 4D:
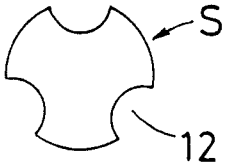

U-shaped grooves of different depths as shown in FIG. 3 were provided on the peripheries of heat resisting aluminum alloy element wires 4.8 mmϕ in outside diameter.

The vibration fatigue resistance of said element wires was examined to obtain the results as shown in Table 4.

The opening of the groove had a width of 1–1.5 mm.

TABLE 4

| Depth of Groove (% relative to diameter of element wire) | Vibration Fatigue Resistance (kg/mm$^2$) at 10' Times |
|---|---|
| 0 | 5.5 |
| 5 | 5.5 |
| 10 | 5.5 |
| 20 | 5.5 |
| 30 | 4.0 |

It has been found from Table 4 that, when the depth of the groove is as much as 30% of the diameter of the element wire, the vibration fatigue resistance of the wire is decreased thereby reducing the utility of said wire for use in a cable.

EXAMPLE 5

Samples of ACSR of the same construction as that of 810 mm$^2$ ACSR were produced by use of aluminum element wires 4.8 mmϕ in outside diameter for the outer layer of the cable with 4 grooves formed continuously and longitudinally of said wires respectively, each of said grooves having a U-shaped profile as shown in FIG. 3 with its opening having a width of 1 mm and its depth extending to 20% of the diameter of said wire.

The ACSR samples thus produced were subjected to different surface treatments as shown in Table 5 and then to an audible noise test.

The audible noise test was made under the conditions of maximum surface potential gradient 14.0 KV/cm after flooding for 1 minute at an intensity of 1.6 mm/hr on the hypothesis of directly after rainfall.

By way of comparison, the same test was made on an ordinary 810 mm$^2$ ACSR (No. 10). Table 5 shows the results of the test.

The rough surface treatment was effected by sand blast treatment.

TABLE 5

| | No. | Rough Surface Treatment | Hydrated Film Treatment: Treatment Temperature (°C.) | Hydrated Film Treatment: Treatment Time (min) | Audible Noise Test [Audible noise level in lapse of 3 minutes after suspension of flooding] (dB, A Characteristic) |
|---|---|---|---|---|---|
| Samples of Invention | 1 | — | — | — | 49 |
| | 2 | without | in aqueous vapor 130° C. | 20 | 46 |
| | 3 | " | in aqueous vapor 130° C. | 50 | 44 |
| | 4 | " | in aqueous vapor 140° C. | 30 | 42 |
| | 5 | with | in aqueous vapor 100° C. | 10 | 44 |

TABLE 5-continued

| | No. | Rough Surface Treatment | Hydrated Film Treatment Treatment Temperature (°C.) | Hydrated Film Treatment Treatment Time (min) | Audible Noise Test [Audible noise level in lapse of 3 minutes after suspension of flooding] (dB, A Characteristic) |
|---|---|---|---|---|---|
| | 6 | " | in aqueous vapor 120° C. | 10 | 40 |
| | 7 | " | in aqueous vapor 140° C. | 10 | 39 |
| | 8 | " | in water 95° C. | 30 | 46 |
| | 9 | " | in water 95° C. | 60 | 45 |
| Comparative Sample | 10 | — | — | — | 53 |

It has been found from Table 5 that the ACSR samples according to the invention have a high effect in reducing the audible noise levels by as much as 4–14 dB compared with the case of the conventional ACSR.

What is claimed is:

1. A process for making a low audible noise compound cable comprising wires selected from the group consisting of aluminum wire, aluminum alloy wire, aluminum-clad steel wire and aluminum alloy-clad steel wire stranded at least on the outer periphery of said cable, wherein the surface of each wire on the outer periphery of said cable is covered by a hydrated film as a result of having been treated in water or aqueous vapor having a temperature of 90° C. or greater, thereby enabling the surface of the cable to have a hydrophilic property, which process comprises providing a compound cable comprising said wires having wire drawing lubricant thereon and stranded at least on the outer periphery of said cable, treating said cable with organic solvent to remove said lubricant from the outer periphery of said cable, subjecting the surface of said cable to a blast treatment or liquid honing treatment to roughen the outer periphery of said cable, and treating said roughened cable in water or aqueous vapor having a temperature of 90° C. or greater to form said hydrated film.

2. A process according to claim 1, wherein said blast treatment or liquid honing treatment results in a roughness of 10–50μ for the outer periphery of said cable.

3. A process according to claim 2, wherein said treatment in water or aqueous vapor results in substantially doubling the roughness of the outer periphery of said cable, from 10–50μ to 20–100μ.

4. A process according to claim 1, wherein said roughened compound cable is treated in aqueous vapor having a pressure above 2 $Kg/cm^2$ and a temperature above 120° C. to form said hydrated film.

5. A process for making a low audible noise compound cable comprising wires selected from the group consisting of aluminum wire, aluminum alloy wire, aluminum-clad steel wire and aluminum alloy-clad steel wire stranded at least on the outer periphery of said cable, wherein the surface of each wire on the outer periphery of said cable is covered by a hydrated film as a result of having been treated in water or aqueous vapor having a temperature of 90° C. or greater, thereby enabling the surface of the cable to have a hydrophilic property, which process comprises providing said wires having wire drawing lubricant thereon, treating said wires with organic solvent to remove said lubricant from said wires, subjecting the surface of said wires to a blast treatment or liquid honing treatment to roughen the surface of said wires, treating said roughened wires in water or aqueous vapor having a temperature of 90° C. or greater to form said hydrated film on said wires, and stranding said treated wires to form said outer periphery of said cable.

6. A process according to claim 5, wherein said blast treatment or liquid honing treatment results in a roughness of 10–50μ for the surface of said wires.

7. A process according to claim 6, wherein said treatment in water or aqueous vapor results in substantially doubling the roughness of the surface of said wires, from 10–50μ to 20–100μ.

8. A process according to claim 5, wherein said wires are treated in aqueous vapor having a pressure above 2 $Kg/cm^2$ and a temperature above 120° C. to form said hydrated film.

* * * * *